US009345976B2

(12) United States Patent
Li et al.

(10) Patent No.: US 9,345,976 B2
(45) Date of Patent: May 24, 2016

(54) TOY FIGURINE WITH REMOVABLE FEATURES

(75) Inventors: Josiah To Sang Li, Monterey Park, CA (US); William J. Kerner, Redondo Beach, CA (US); James Austin Rucker, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 420 days.

(21) Appl. No.: 13/594,441

(22) Filed: Aug. 24, 2012

(65) Prior Publication Data

US 2013/0225038 A1 Aug. 29, 2013

Related U.S. Application Data

(60) Provisional application No. 61/528,334, filed on Aug. 29, 2011.

(51) Int. Cl.

| | |
|---|---|
| ***A63H 3/20*** | (2006.01) |
| ***A63H 3/00*** | (2006.01) |
| ***A63H 13/10*** | (2006.01) |

(52) U.S. Cl.

CPC ..... *A63H 3/003* (2013.01); *A63H 13/10* (2013.01)

(58) Field of Classification Search

CPC ..... A63H 3/20
USPC ..... 446/330
See application file for complete search history.

(56) References Cited

U.S. PATENT DOCUMENTS

| | | | | |
|---|---|---|---|---|
| 276,539 | A | 4/1883 | Reed | |
| 1,277,702 | A | 9/1918 | Des Combes | |
| 2,385,724 | A | 9/1945 | Olson | |
| 2,611,997 | A * | 9/1952 | Solloway et al. | 446/310 |
| 2,731,767 | A * | 1/1956 | Holt | 446/38 |
| 3,151,866 | A * | 10/1964 | Glass et al. | 273/359 |
| 3,277,602 | A * | 10/1966 | Speers et al. | 446/380 |
| 3,425,153 | A * | 2/1969 | Crosman et al. | 446/308 |
| 3,688,435 | A * | 9/1972 | Jurgis Sapkus et al. | 446/310 |
| 3,724,125 | A * | 4/1973 | Goldfarb et al. | 446/330 |
| 4,095,367 | A * | 6/1978 | Ogawa | A63H 33/003 446/288 |
| 4,118,888 | A * | 10/1978 | Ogawa | 446/92 |
| 4,125,961 | A * | 11/1978 | Yamashina | 446/308 |
| 4,180,939 | A * | 1/1980 | Matsushiro | 446/38 |
| 4,185,412 | A * | 1/1980 | Rahmstorf | 446/98 |
| 4,192,093 | A | 3/1980 | Hamano | |
| 4,206,564 | A * | 6/1980 | Ogawa | A63H 33/003 446/94 |
| 4,249,339 | A | 2/1981 | Crain et al. | |
| 4,382,347 | A | 5/1983 | Murakami | |
| 4,464,860 | A | 8/1984 | Onodera | |
| 4,516,948 | A | 5/1985 | Obara | |
| 4,530,670 | A | 7/1985 | Ohno | |
| 4,583,958 | A | 4/1986 | Matsuda | |

(Continued)

FOREIGN PATENT DOCUMENTS

| | | | |
|---|---|---|---|
| EP | 0700703 | A2 | 3/1996 |
| GB | 2133711 | A | 8/1984 |
| WO | 2004/041388 | A1 | 5/2004 |

*Primary Examiner* — Michael Dennis

*Assistant Examiner* — Dolores Collins

(74) *Attorney, Agent, or Firm* — Edell, Shapiro & Finnan, LLC

(57) ABSTRACT

A toy figurine is disclosed. The toy figurine includes a body to which one or more plates are coupled. The toy figurine includes a launching mechanism that is used to launch a projectile from the toy figurine. The plates cover the launching mechanism when the plates are mounted to the body.

19 Claims, 13 Drawing Sheets

(56) References Cited

U.S. PATENT DOCUMENTS

| | | | | |
|---|---|---|---|---|
| 4,595,378 | A | 6/1986 | Sweet et al. | |
| 4,654,018 | A * | 3/1987 | Farrington | A63H 27/14 446/308 |
| 4,673,367 | A | 6/1987 | MacBain | |
| 4,723,931 | A * | 2/1988 | Allen | A63H 3/16 446/268 |
| 4,737,135 | A | 4/1988 | Johnson et al. | |
| D311,043 | S | 10/1990 | Kunihiro | |
| 5,052,969 | A * | 10/1991 | Smith | 446/268 |
| 5,268,804 | A * | 12/1993 | Wallis | 360/78.04 |
| 5,299,809 | A | 4/1994 | Evangelista et al. | |
| 5,304,087 | A * | 4/1994 | Terzian et al. | 446/340 |
| 5,334,073 | A * | 8/1994 | Tilbor et al. | 446/308 |
| 5,380,231 | A | 1/1995 | Brovelli | |
| 5,525,086 | A * | 6/1996 | Gentile et al. | 446/41 |
| 5,906,528 | A | 5/1999 | Ostendorff et al. | |
| 5,924,910 | A | 7/1999 | Liu | |
| 5,949,619 | A * | 9/1999 | Eckberg et al. | 360/291 |
| D424,632 | S | 5/2000 | Hollis et al. | |
| 6,056,623 | A | 5/2000 | Arriola | |
| 6,086,446 | A | 7/2000 | Arriola | |
| 6,106,356 | A | 8/2000 | Trageser | |
| 6,257,948 | B1 | 7/2001 | Silva | |
| 6,350,172 | B1 * | 2/2002 | Andrews | B62K 13/00 446/435 |
| 6,490,119 | B1 * | 12/2002 | Mittal et al. | 360/78.05 |
| 6,547,627 | B1 * | 4/2003 | Oathout | B63B 25/002 446/208 |
| 6,547,629 | B1 * | 4/2003 | Dubois et al. | 446/297 |
| 6,663,463 | B1 | 12/2003 | Dougherty et al. | |
| 6,755,716 | B2 | 6/2004 | Agostini et al. | |
| 6,791,786 | B2 * | 9/2004 | He et al. | 360/78.05 |
| 6,824,442 | B2 | 11/2004 | Andrews et al. | |
| 7,575,496 | B2 | 8/2009 | Lau et al. | |
| 7,686,669 | B2 | 3/2010 | Sun et al. | |
| 8,338,271 | B2 * | 12/2012 | Sugiura et al. | 438/463 |
| 8,374,724 | B2 * | 2/2013 | Wieland et al. | 700/264 |
| 8,382,551 | B2 * | 2/2013 | Hong | 446/376 |
| 2005/0269767 | A1 | 12/2005 | Bedford et al. | |
| 2006/0030236 | A1 | 2/2006 | Ueno et al. | |
| 2006/0270320 | A1 | 11/2006 | Proch | |
| 2007/0173174 | A1 | 7/2007 | Sun et al. | |
| 2008/0064293 | A1 | 3/2008 | Wade | |
| 2009/0075550 | A1 | 3/2009 | Sun et al. | |
| 2009/0075556 | A1 | 3/2009 | Sun et al. | |
| 2009/0075559 | A1 | 3/2009 | Barthold | |
| 2010/0291833 | A1 | 11/2010 | O'Connor et al. | |
| 2011/0076915 | A1 | 3/2011 | Campbell et al. | |
| 2011/0086572 | A1 | 4/2011 | De La Torre et al. | |
| 2011/0130070 | A1 * | 6/2011 | Hong | 446/330 |
| 2013/0225038 | A1 * | 8/2013 | Li et al. | 446/330 |

* cited by examiner

TOY FIGURINE WITH REMOVABLE FEATURES

CROSS-REFERENCE TO RELATED APPLICATION

This application claims priority to and the benefit of U.S. Provisional Patent Application No. 61/528,334, filed Aug. 29, 2011, entitled "Toy Figure with Removable Features" the entire disclosure of which is incorporated herein by reference in its entirety.

FIELD OF THE INVENTION

The present invention relates to a toy figure or figurine, and in particular, to a toy figure or figurine that has one or more portions that are removable from the body of the toy figure or figurine.

BACKGROUND OF THE INVENTION

Conventional toy figurines, such as action figurines and dolls, are used in various play environments by children. Play involving a toy figurine can be enhanced via accessories designed for use with the toy figurine.

There is a need for an accessory that is useable with a toy figurine to change easily the manner in which the toy figurine is used.

SUMMARY OF THE INVENTION

The present invention is directed to a toy figurine. The toy figurine includes a body, which may include a torso portion, legs, arms, and a head. In some embodiments, a removable portion is coupled to the torso portion. The removable portion may be located in a chest area of the toy figurine and may have a configuration resembling a plate. In other embodiments, the removable portion is located on an appendage of the figurine, such as a shoulder or an arm. In some embodiments, the toy figurine has two plates that are removably coupled to the toy figurine.

The toy figurine includes a launching mechanism that is actuatable to launch or propel a projectile from the toy figurine. The launching mechanism may be located in an interior region of the toy body and a projectile is inserted into an opening on the torso to load the projectile. In some embodiments, the launching mechanism is located on the front of the torso of the body. In other embodiments, the launching mechanism is located at another location on the body, such as the end of an appendage including a toy figurine's arm or a toy figurine's shoulder. Access to the launching mechanism, to couple a projectile thereto for launching, may be prevented or blocked by one or more of the removable portions.

Once the removable portions are released, a child loads a projectile into the launching mechanism. In other embodiments, the launching mechanism may be pre-loaded with a duplicate projectile, such that the duplicate projectile is ready to launch immediately after the removable portions are released. The toy figurine may include a release mechanism that is actuatable to release the removable portions from the toy figurine body. In some embodiments, a release mechanism is provided for each of the removable portions, and each of the release mechanisms is independently actuatable.

A release mechanism may include actuators that are located in channels formed in the torso of the toy figurine body. The internal actuators are slidably mounted in the channels and movable between a disengaged position, in which the actuator does not contact a removable portion, and an engaged position, in which the actuator contacts a removable portion. In some embodiments, each removable portion is mounted to and retained on the toy figurine body via a friction fit. In other embodiments, each removable portion is mounted to and retained on the toy figurine body via a catch that engages the removable portion. The catch retains the removable portion on the toy figurine body against the bias of a biasing mechanism, such as a spring.

In some friction fit embodiments, movement of an actuator into engagement with a removable portion and along a sufficient distance causes the removable portion to move relative to the toy figurine body and separate from the body. In some catch embodiments, movement of the actuator into engagement with a release mechanism actuates the catch, which allows the removable portion to be biased or forced away from the toy figurine body via a biasing member.

The toy figurine includes openings extending from the outside of the toy figurine to the locations where the internal actuators are located. A child can insert a projectile into an opening on the toy figurine to engage the projectile with one of the internal actuators. In some embodiments, such engagement results in the removable portion being pushed away from the toy figurine body by the actuator. In other embodiments, such engagement results in the release of a catch retaining the removable portion to the body.

Once one or more projectiles have been used to release the removable portions, each of the projectiles is inserted into the launching mechanism and subsequently launched via an actuator located on the rear side of the toy figurine body.

BRIEF DESCRIPTION OF THE DRAWINGS

Like reference numerals have been used to identify like elements throughout this disclosure.

DETAILED DESCRIPTION OF THE INVENTION

A toy figurine according to the present invention includes a body and one or more removable portions that are coupled to the body. As described above, the body may include any number of appendages or portions, such as legs, arms, a chest portion and a head portion. The removable portions may be coupled to the body via friction or a catch mechanism. The removable portions are separable from the body by pushing the portions away from the body. Alternatively, the removable portions are launchable away from the body via a spring mechanism.

The toy figurine includes a launching mechanism that is configured to launch projectiles. In some embodiments, a removable portion is separated from the toy figurine body using a projectile. When a projectile is inserted into an opening formed in the toy figurine, the projectile engages an internal actuator or mechanism that in turn releases or forces the removable portion away from the body. Removal of the removable portion may reveal the launching mechanism and/or allow the launching mechanism to launch a projectile.

Figure 1:
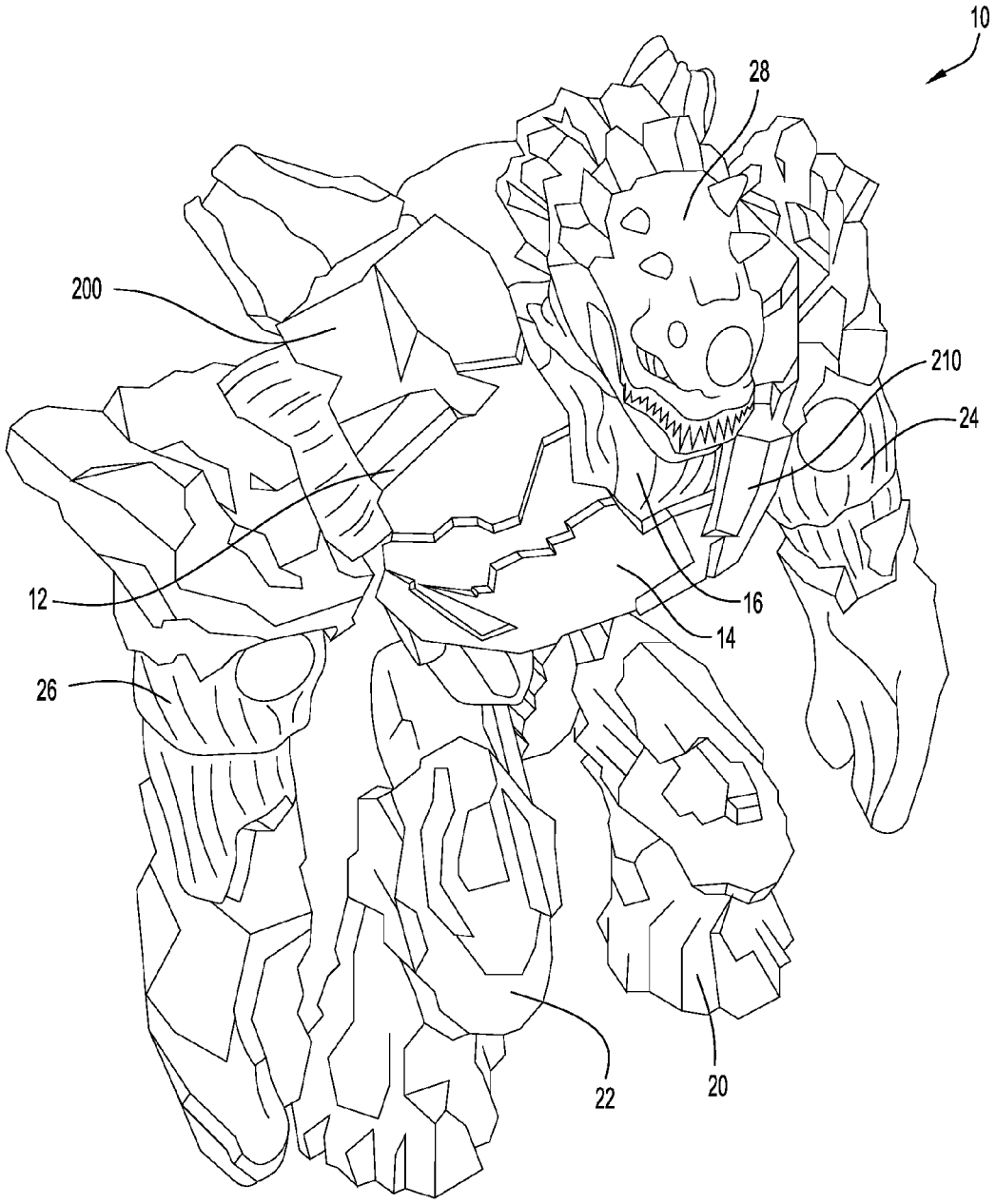
FIG. 1 illustrates a top front perspective view of a toy figurine according to the present invention.

An embodiment of a toy figurine according to the present invention is illustrated in FIG. 1. In this embodiment, the toy figurine 10 includes a body 12 that has a torso 14, legs 20 and 22, and arms 24 and 26. Each of the legs 20 and 22 and the arms 24 and 26 is pivotally coupled to the torso 14. In different embodiments, one or more of the legs 20 and 22 and the arms 24 and 26 is fixedly coupled to the torso 14. The toy figurine 10 also includes a head 28 that is coupled to the torso 14. The torso 14 has a front side 16 (see FIG. 1) and a rear side 18 (see FIG. 2).

Referring back to FIG. 1, the toy figurine 10 also includes a pair of plates 200 and 210 that are coupled to the torso 14. The plates 200 and 210 are located in the chest area of the toy figurine 10. The plates 200 and 210 are referred to alternatively as chest plates or removable portions.

In this embodiment, the plates 200 and 210 are removably coupled to the torso 14. The plates 200 and 210 are launchable or separable from the torso 14. As described below, the toy figurine 10 has a launching mechanism that is useable to launch a projectile. In some embodiments, a projectile may include a long, narrow, detachable piece that is coupleable to the toy figurine either via the launching mechanism or via other openings, clips, protrusions, or recesses in, on or about the toy figurine. The launching mechanism is covered by the plates 200 and 210 when the plates 200 and 210 are coupled to the torso 14. Removal of the plates 200 and 210 exposes the launching mechanism and allows for a projectile to be launched by the launching mechanism.

Figure 2:
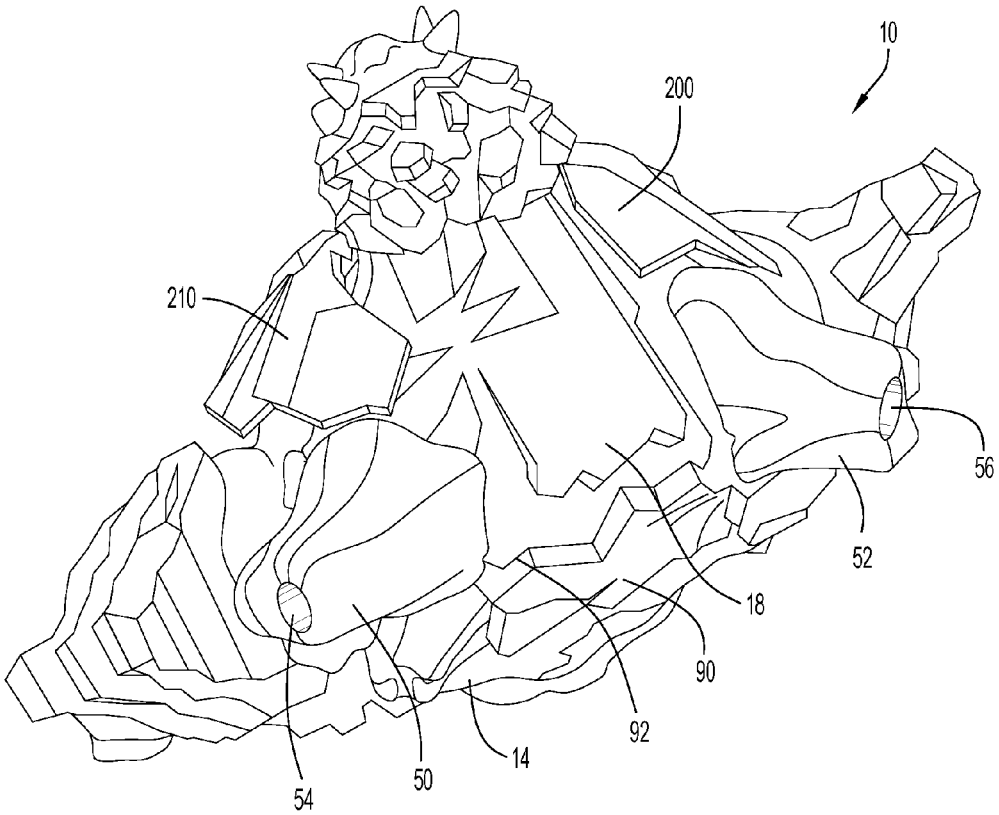
FIG. 2 illustrates a top rear perspective view of the toy figurine illustrated in FIG. 1.

Referring to FIG. 2, a top rear perspective view of the toy figurine 10 is illustrated. The plates 200 and 210 are configured to wrap around a portion of the torso 14, in this embodiment, the shoulders of the toy figurine 10. On the rear side 18 of the torso 14, the toy figurine 10 includes two projections 50 and 52 extending therefrom which are located proximate to the shoulders of the toy figurine 10. The projections 50 and 52 have holes or channels 54 and 56 extending therethrough, respectively. The channels 54 and 56 are configured to receive projectiles, which are used to decouple the plates 200 and 210 from the body 12, as described below.

The toy figurine 10 also includes an actuator 90 that is located in an opening 92 formed in the rear side 18 of the torso 14. A child can press the actuator 90 inwardly to actuate the launching mechanism in the interior region of the toy figurine body 12, thereby launching a projectile from the toy figurine 10. In an alternative embodiment, the actuator is positioned at a different location on the toy figurine 10 than the rear side or surface 18 of the torso 14. For example, in some embodiments, the actuator is located beneath one or both of the plates 200 and 210 and is accessible once the plates 200 and 210 are separated from the toy figurine 10.

Figure 3:
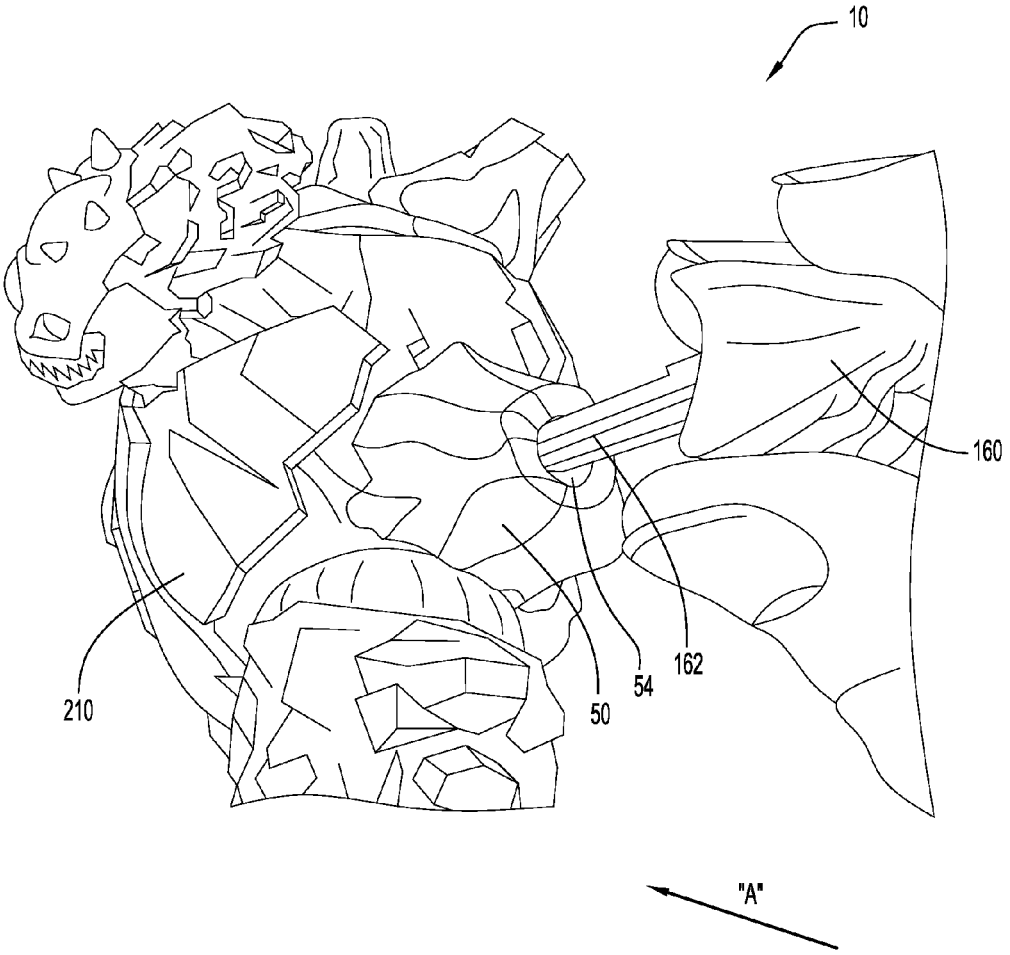
FIG. 3 illustrates a side view of a portion of the toy figurine illustrated in FIG. 1 with a projectile being inserted.

Referring to FIG. 3, a projectile 160, which is launchable from the body 12 via the launching mechanism, is illustrated as being inserted into the projection 50. In particular, the projectile 160 has a shaft 162 that is inserted into the channel 54 of the projection 50 along the direction of arrow "A." Such a movement of the projectile 160 results in the detachment of the plate 210. In alternative embodiments, the projectile 160 may be moved laterally (e.g. slid to the side) or turned once inserted into the projection 50 to activate detachment of the plate 210. In yet other embodiments, a first action triggers the detachment of the plate 210, while a second action triggers actuation of the launching mechanism. For example, insertion of the projectile 160 may trigger detachment of the plate 210, while turning the projectile 160 after insertion may actuate the launching mechanism.

Figure 4:
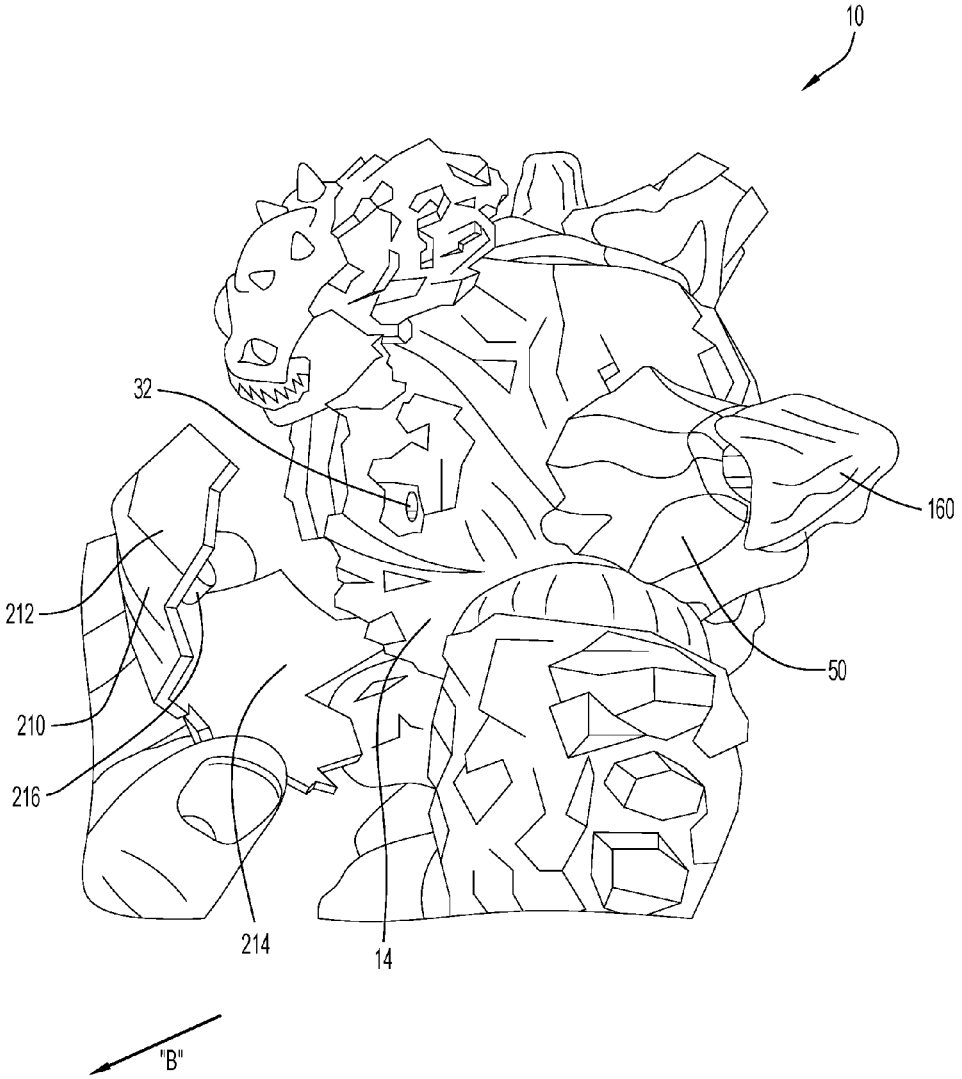
FIG. 4 illustrates a side view of the portion of the toy figurine illustrated in FIG. 3 with a plate being removed.

Referring to FIG. 4, the projectile 160 is inserted into the projection 50. As it is inserted, the projectile 160 engages an actuator that is located in the body 12 of the toy figurine 10. The front side 16 of the torso 14 includes a pair of holes or openings (only opening 32 is illustrated in FIG. 4). As the projectile 160 is inserted, the plate 210 is removed or decoupled from the torso 14 along the direction arrow "B." The plate 210 has an outer surface 212 and an inner surface 214. Extending from the inner surface 214 of the plate 210 is a post 216 that is insertable into the opening 32 to couple or mount the plate 210 to the torso 14. The post 216 includes an alignment shoulder (not shown in FIG. 4) that is aligned with a slot formed with opening 32 to ensure that the post 216 is inserted in the proper orientation to mount the plate 210 correctly to the toy figurine 10.

Figure 5:
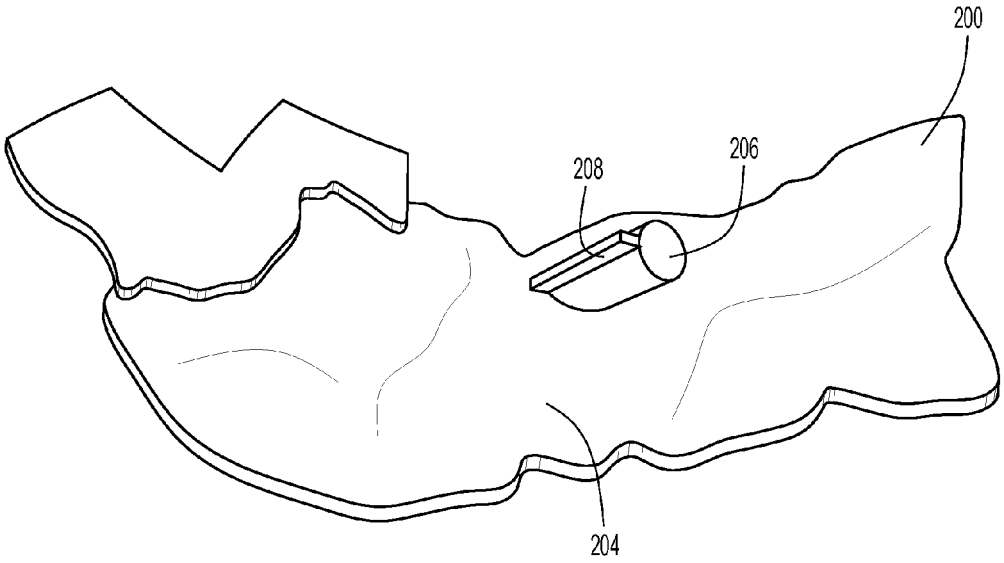
FIG. 5 illustrates a perspective view of a plate illustrated in FIG. 1.

A perspective view of plate 200 is illustrated in FIG. 5. As shown, plate 200 has an inner surface 204 from which extends a post 206. The post 206 has an alignment mechanism 208 that ensures that the plate 200 is coupled to the toy figurine 10 in the proper orientation.

Figure 6:
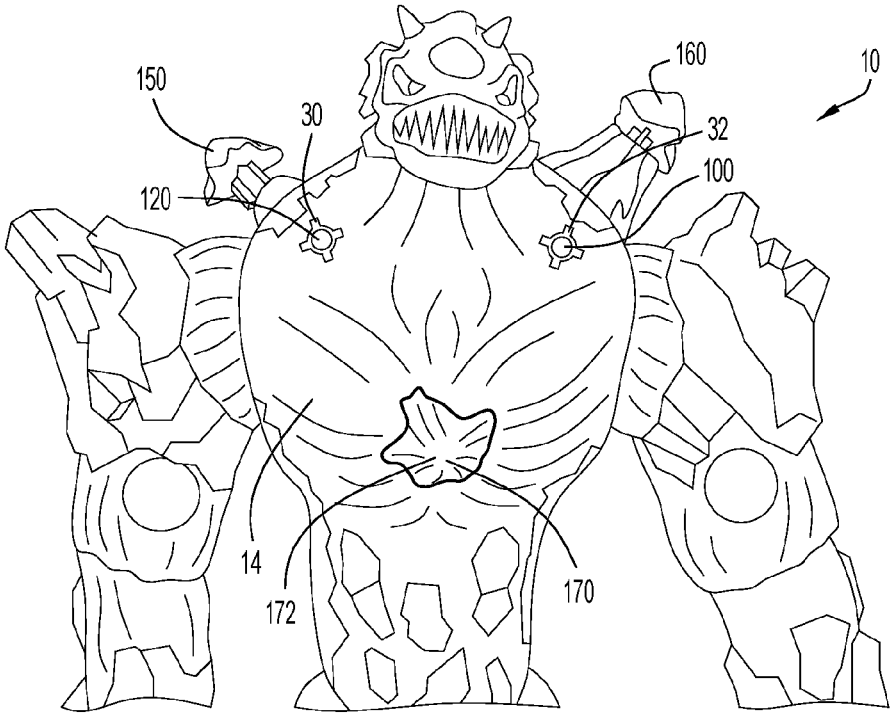
FIG. 6 illustrates a front view of the toy figurine illustrated in FIG. 1 with its plates removed and a projectile in its launching position.
Figure 7:
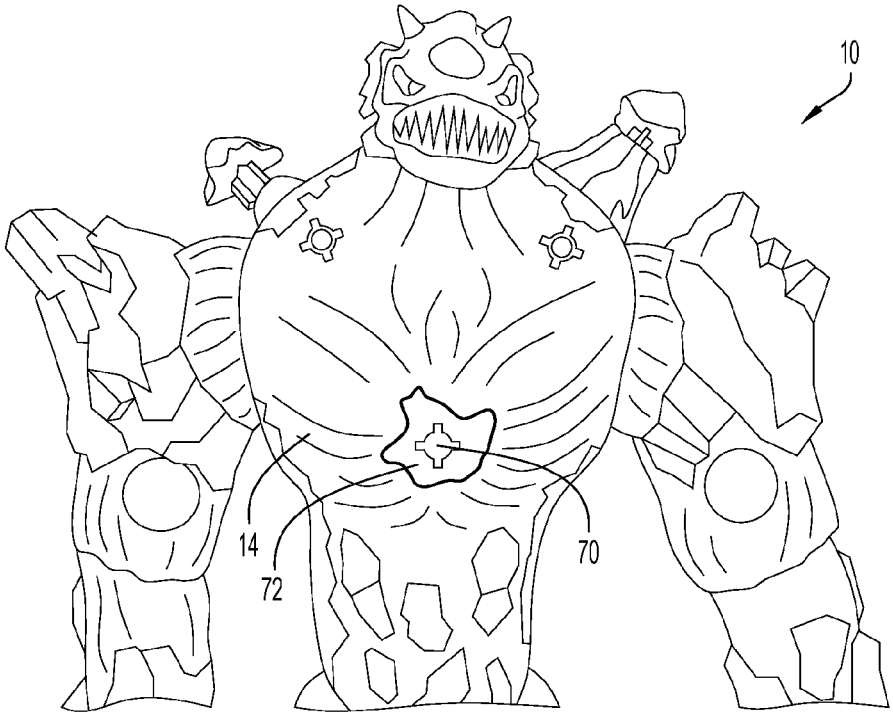
FIG. 7 illustrates a front view of the toy figurine illustrated in FIG. 6 with the projectile removed.

Referring to FIGS. 6 and 7, front views of the toy figurine 10 with the plates 200 and 210 removed from the torso 14 are illustrated. Projectiles 150 and 160 have been inserted into the projections 50 and 52 on the rear of the toy figurine 10. Actuators 120 and 100 are located in the openings 30 and 32, respectively. As shown, an end of an actuator 100 is located in the opening 32 in the torso 14. The end of the actuator 100 contacts the post 216 of the plate 210 and pushes the post 216 out of the opening 32. Once post 216 separates from the opening 32, the plate 210 falls away from the toy figurine 10.

As shown in FIG. 7, the torso 14 has another opening 70 formed therein. The opening 70 is in communication to an interior region or chamber of the toy figurine body in which a spring-loaded launching mechanism is located. The front side 16 has a recessed area 72 located around the opening 70. The recessed area 72 is sized to receive the head 172 of the projectile 170, the shaft of which is inserted into opening 70 and coupled to the launching mechanism.

Figure 8:
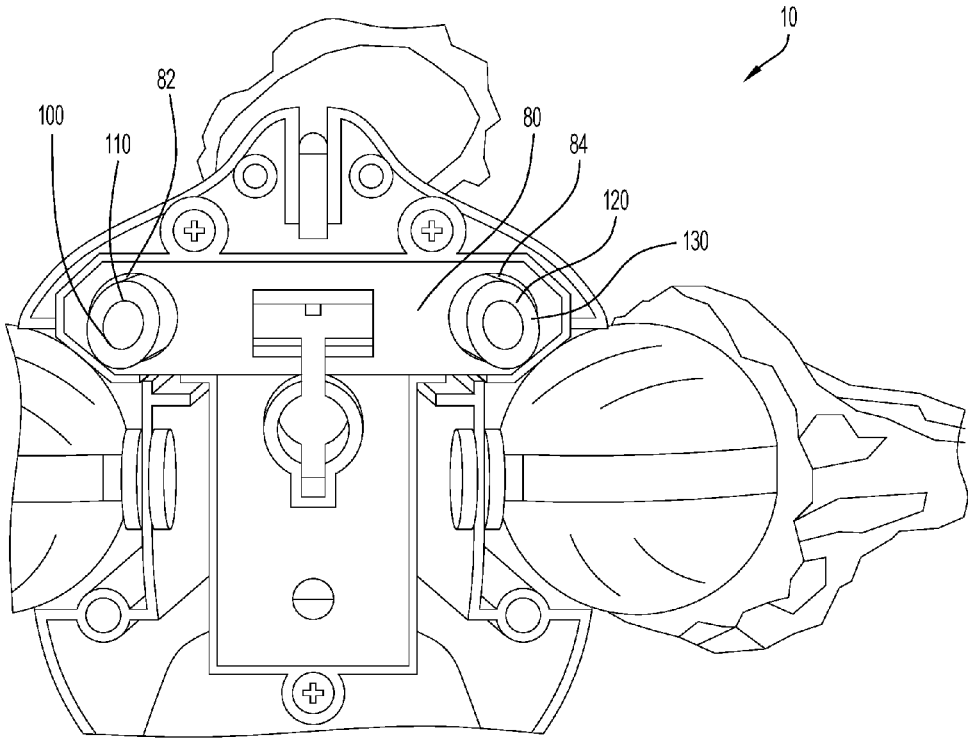
FIG. 8 illustrates a rear view of a portion of the torso of the toy figurine illustrated in FIG. 1 with an outer shell removed.

Referring to FIG. 8, a rear view of the toy figurine 10 is illustrated. The rear shell or outer body portion of the toy figurine 10 is removed to expose some of the internal components of the toy figurine 10. The toy figurine 10 includes a frame 80 that has openings 82 and 84 into which actuators 100 and 120 are inserted. Actuator 100 includes an engagement surface 110 that is contactable by a projectile (such as projectile 160 in FIG. 6) to move the actuator 100 relative to the body 12. Similarly, actuator 120 includes an engagement surface 130 that is contactable by a projectile (such as projectile 150 in FIG. 6) to move the actuator 120 relative to the body 12. The actuators 100 and 120 are moved in a similar manner, but are independently movable. In an alternative embodiment, the actuators 100 and 120 are coupled together and engagement of one of the actuators 100 and 120 results in both actuators 100 and 120 moving simultaneously.

Figure 9:
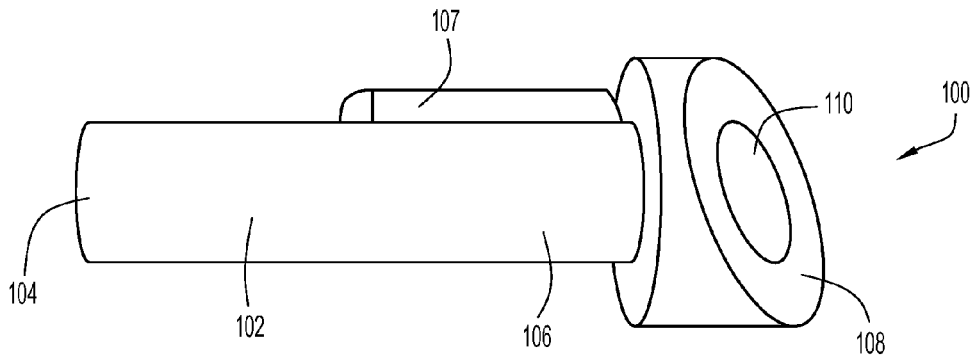
FIG. 9 illustrates a side view of an actuator of the toy figurine illustrated in FIG. 1.
Figure 10:
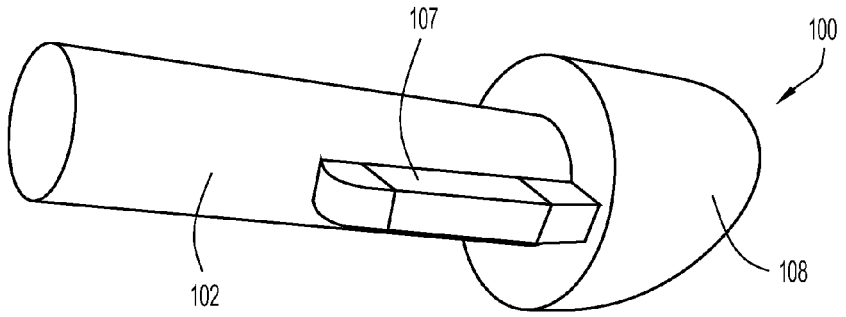
FIG. 10 illustrates a perspective view of the actuator illustrated in FIG. 9.

Referring to FIGS. 9 and 10, an embodiment of an actuator is illustrated. The actuator 100 includes a shaft 102 with opposite ends 104 and 106 and a body 108 coupled to end 106. The body 108 has an engagement surface 110 that is beveled so that an inserted projectile engages and slides along the beveled surface 110 to move the actuator 100. The shaft 102 includes an alignment guide 107 that is used, with a notch or groove, to ensure that the actuator 100 is properly aligned and inserted into the channel 60.

Figure 11:
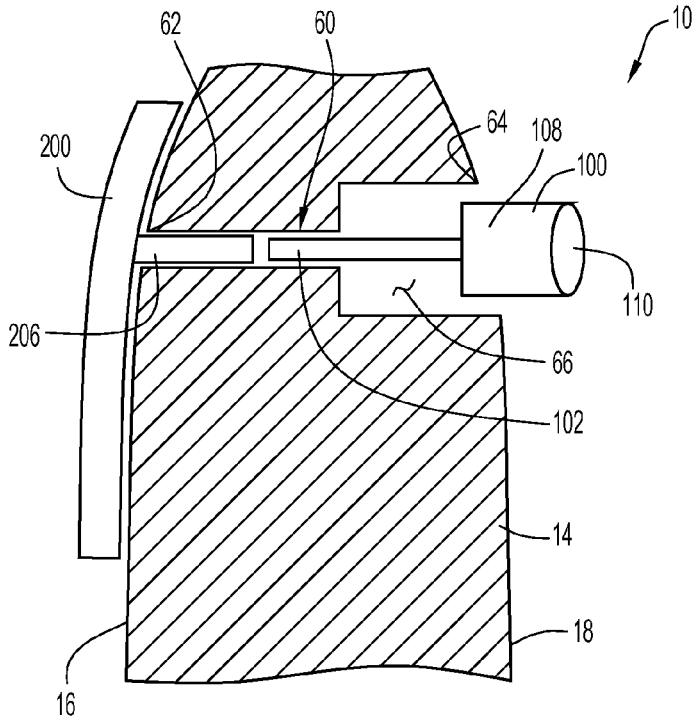
FIG. 11 illustrates an internal cross-section of a toy figurine illustrated in FIG. 1 with a plate coupled thereto.
Figure 12:
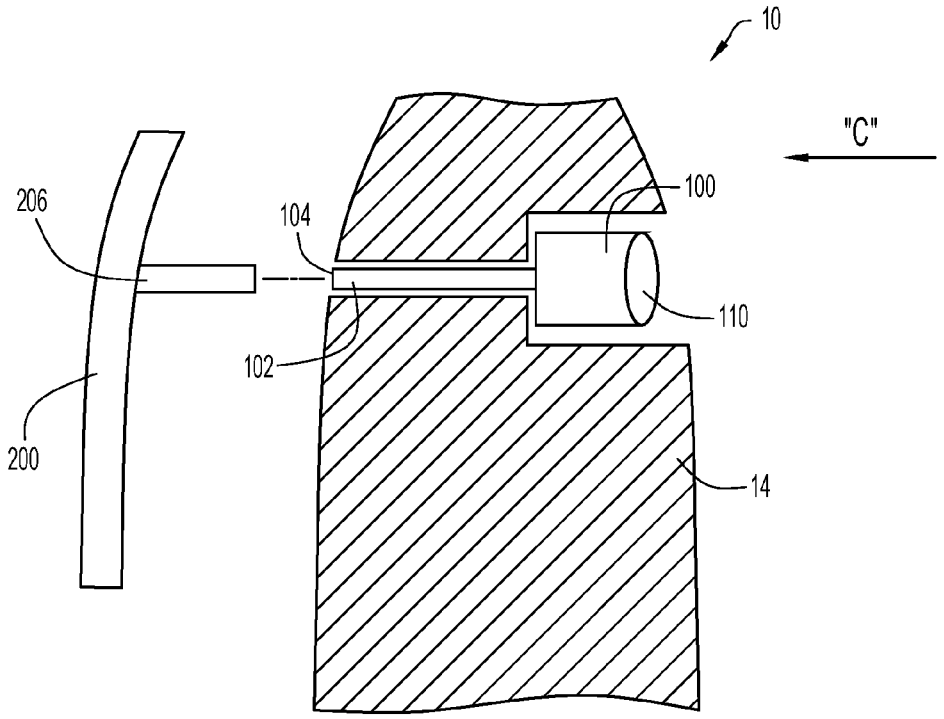
FIG. 12 illustrates an internal cross-section of a toy figurine illustrated in FIG. 11 with the plate removed.

As the actuators 100 and 120 move in similar manner, only the movement of actuator 100 is illustrated in and described relative to FIGS. 11 and 12 for simplicity. Referring to FIG. 11, a cross-sectional view of the torso 14 with front surface 16 and rear surface 18 is illustrated. In this embodiment, the torso 14 includes a channel 60 that extends from the front surface 16 to the rear surface 18. The channel 60 has opposite ends 62 and 64 and a section 66 with a larger diameter than the other section. End 62 corresponds to opening 32 in the torso 14.

The plate 200 is coupled to the torso 14 with the post 206 inserted into the channel 60. An actuator 100 is located in the channel 60 and can slide therein between a non-engaging position (see FIG. 11) and an engaging or dislodging position (see FIG. 12). The body 108 of the actuator 100 is located in the larger diameter portion 66 of the channel 60. When a projectile, such as projectile 150 or 160, engages the surface 110 of the actuator 100, the actuator 100 slides along the direction of arrow "C" in FIG. 12. As the actuator 100 moves, the end 104 of the shaft 102 contacts the post 206 of the plate 200 and pushes the post 206 along the direction of arrow "C" as well, thereby dislodging or decoupling the plate 200 from the toy figurine body 12.

Figure 13:
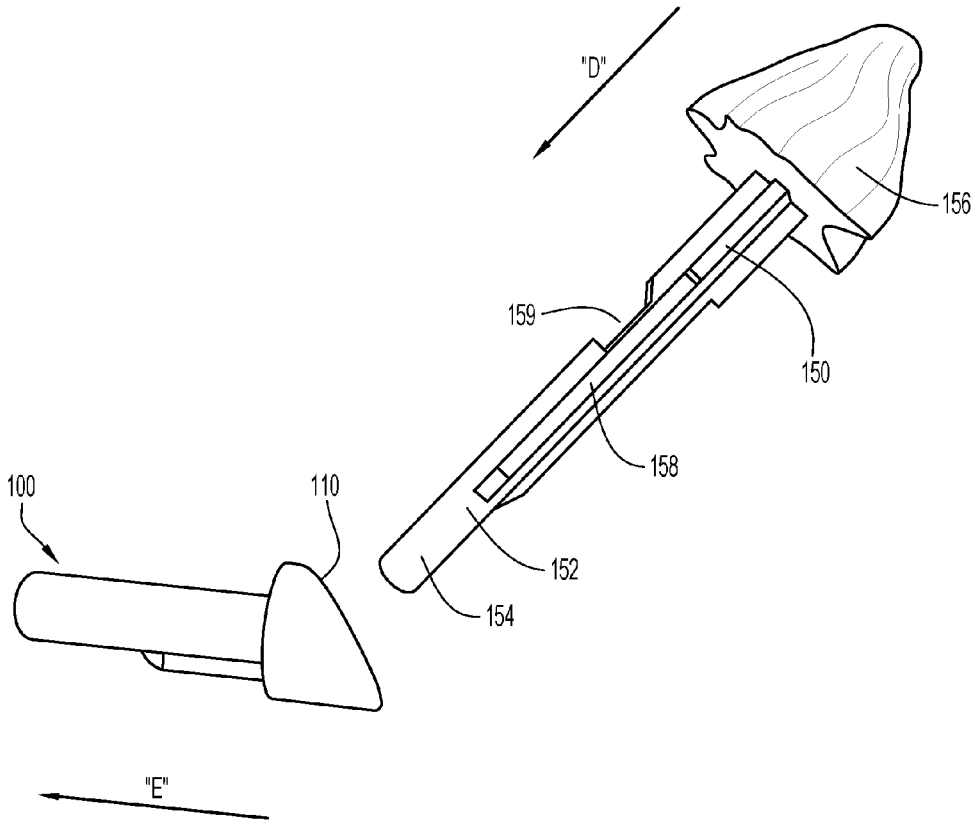
FIG. 13 illustrates a perspective view of an actuator and a projectile.

An embodiment of a projectile according to the present invention is illustrated in FIG. 13. In this embodiment, the projectile 150 has a shaft 152 with an engagement end 154 and a head portion 156. The projectile shaft 152 has an alignment guide or mechanism 158 extending along a portion thereof. The alignment mechanism 158 ensures that the projectile 150 is inserted into the toy body 12 in the proper orientation. The shaft 152 also includes a notch 159 that is engageable by a portion of the launching mechanism in the toy figurine body 12. The notch 159 is engaged to retain the projectile 150 in a loaded position relative to the body 12.

The relative orientations and movements of the projectile 150 and the actuator 100 are illustrated in FIG. 13. As shown, a user can move the projectile 150 along the direction of arrow "D." End 152 of the projectile 150 engages surface 110 of actuator 100, which moves along the direction of arrow "E" along the channel 60 in the torso 14.

Figure 14:
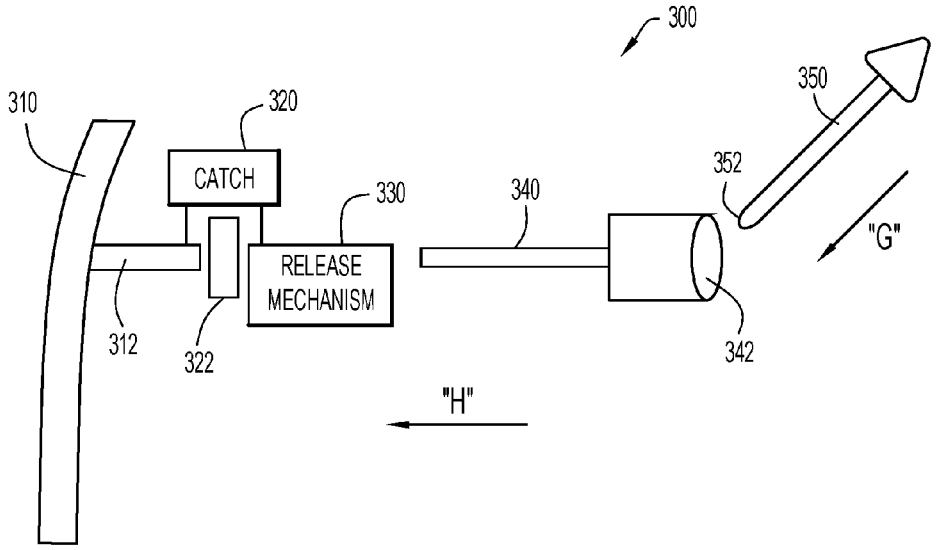
FIG. 14 illustrates a view of some components of an alternative embodiment of a toy figurine according to the present invention.

Referring to FIG. 14, a schematic diagram of an alternative embodiment of a toy figurine is illustrated. Only a few of the components of the toy figurine 300 are illustrated for simplicity. Toy figurine 300 includes a plate 310 with a post 312 that is inserted into a channel (not shown) in the toy figurine 300. The post 312 is biased outwardly by a biasing mechanism, such as a spring, (not shown) so that the plate 310 is projected or launched from the toy figurine 300.

In this embodiment, the toy figurine includes a catch 320 that engages the post 312 to releaseably retain the plate 310 to the toy figurine body against the bias of a biasing member 322, such as a spring. The biasing member 322 is positioned to bias the post 312 along the direction of arrow "H." The toy figurine 300 includes a release mechanism 330 that is coupled to the catch 320. When the release mechanism 330 is activated, the release mechanism 330 releases the catch 320, which allows the biasing member 322 to force the plate 310 away from the toy figurine 300.

As shown in FIG. 14, the toy figurine 300 includes an actuator 340 that is slidably mounted on the body of the toy figurine 300. The actuator 340 is located in a channel similar to the channel 60 in which the actuator 100 is located. A projectile 350 with end 352 is movable by a user along the direction of arrow "G." When the end 352 of projection 350 engages surface 342 of actuator 340, the actuator 340 moves along the direction of arrow "H." Movement of the actuator 340 results in the actuator 340 engaging the release mechanism 330, thereby releasing the catch 320 and allowing the plate 310 to be launched from the toy figurine. In other embodiments, the projectile 350 directly engages the release mechanism 330 to release the catch 320, without an intervening actuator 340.

Figure 15:
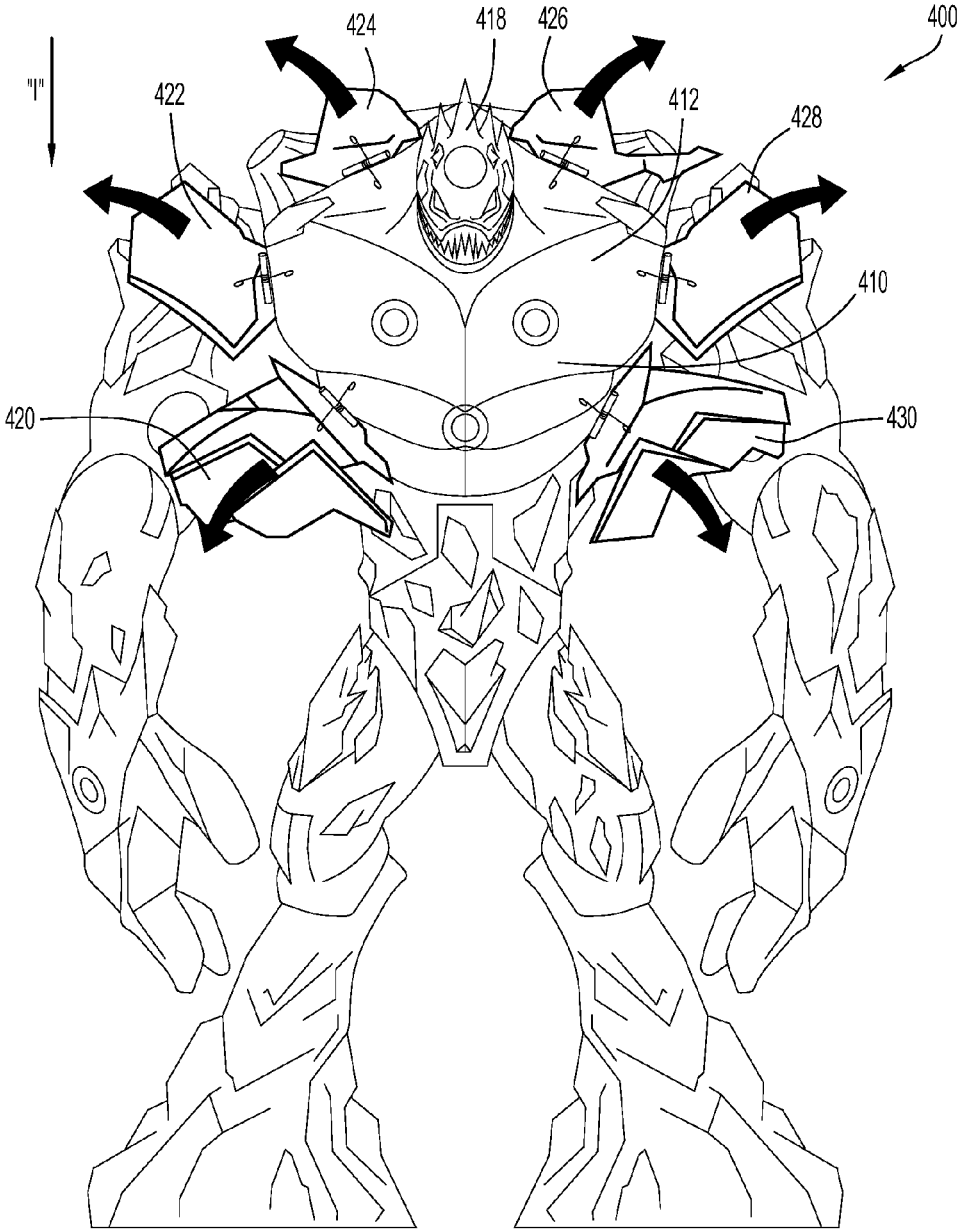
FIG. 15 illustrates a front view of an alternative embodiment of a toy figurine according to the present invention.
Figure 16:
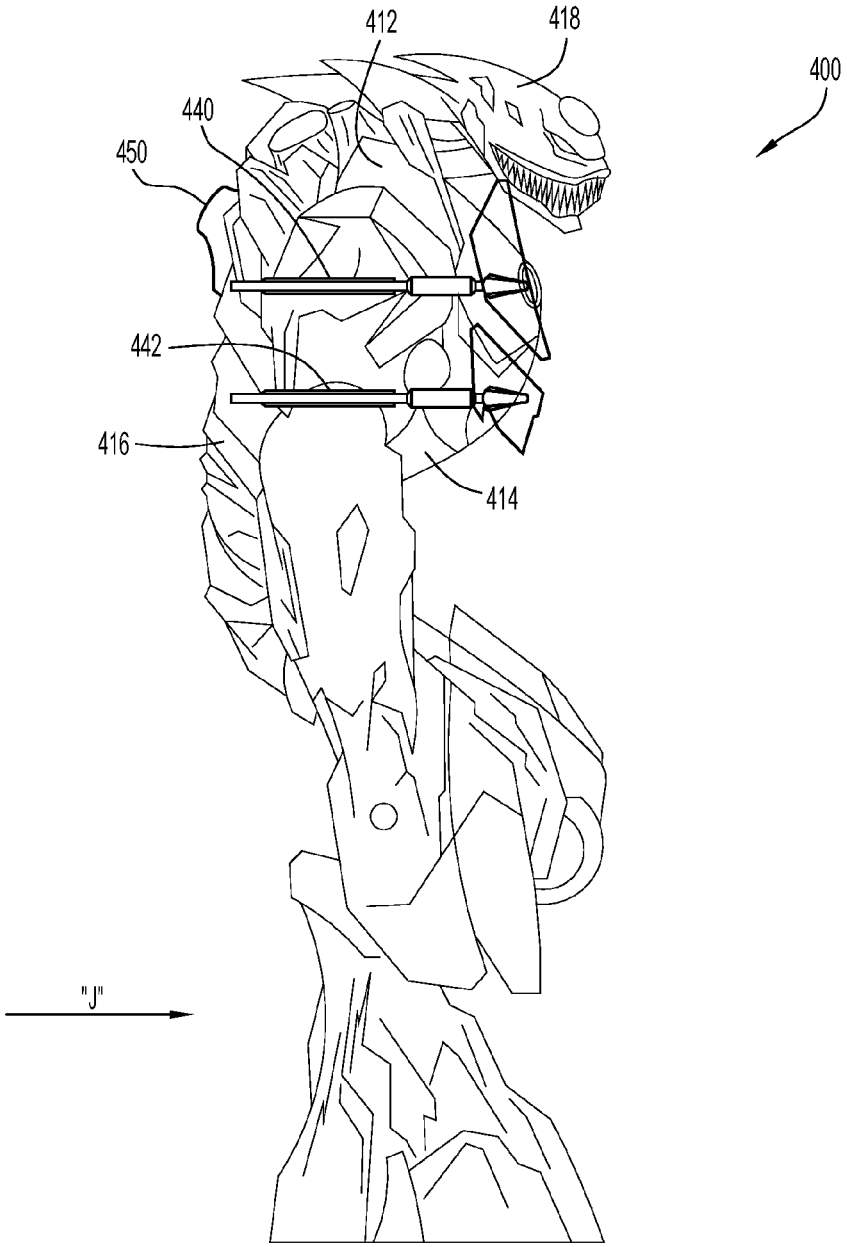
FIG. 16 illustrates a side view of the toy figurine illustrated in FIG. 15.

Referring to FIGS. 15 and 16, an alternative embodiment of a toy figurine according to the present invention is illustrated. In this embodiment, the toy figurine 400 includes a body 410 with a torso 412 and a head 418 movably coupled to the torso 412. The torso 412 has a front side 414 and a rear side 416 (see FIG. 16). The toy figurine 400 includes several removable portions or plates 420, 422, 424, 426, 428, and 430 that are coupled to the torso 412, as shown in FIG. 15. The portions 420, 422, 424, 426, 428, and 430 resemble pieces of armor and are removably coupled to the torso 412 in a manner that permits them to be pushed or launched from the torso 412 via action by a child.

In this embodiment, the toy figurine 400 includes a release mechanism in the interior region of the torso 412. Each of the portions 420, 422, 424, 426, 428, and 430 is retained in a coupled position to the torso 412 via a catch or latch. One or more biasing mechanisms are engaged with the portions 420, 422, 424, 426, 428, and 430 to bias the portions 420, 422, 424, 426, 428, and 430 away from the torso 412. The head 418 of the toy figurine 410 is connected to the release mechanism. Movement of the head 418 along the direction of arrow "I" activates the release mechanism, which results in the portions 420, 422, 424, 426, 428, and 430 being projected or launched from the body 410 by the biasing mechanisms as illustrated in FIG. 15.

The toy figurine body 410 includes channels into which projectiles 440 and 442 can be inserted. The projectiles 440 and 442 are engaged with an internal launching mechanism, that when activated, causes the projectiles 440 and 442 to be launched from the body 410. Once the portions 420, 422, 424, 426, 428, and 430 are decoupled from the body 410, projectiles 440 and 442 can be launched. The body 410 includes an actuator 450 on the rear side 416 that can be pressed by a child to activate the launching mechanism to release and project the projectiles 440 and 442 along the direction of arrow "J." In this embodiment, a single actuation of the actuator 450 results in both projectiles 440 and 442 being simultaneously launched. In other embodiments, an actuation of the actuator 450 results in one of the projectiles being launched and a subsequent actuation results in another one of the projectiles being launched. In other embodiments, a first actuation of the actuator 450 results in one or more of the portions or plates 420, 422, 424, 426, 428, and 430 being launched or decoupled from the body and a second actuation of the actuator 450 results in one or more of the projectiles 440 and 442 being launched.

In an alternative embodiment, a toy figurine according to the present invention includes a single plate coupled thereto. In other embodiments, one or more plates may be coupled to a different portion of the body of the toy figurine than the torso. In other embodiments, the toy figurine may have more than one projectile launching mechanism.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A toy figurine, comprising:

a body including a launching mechanism having an actuator, the body including an actuating opening formed therein;

a plate releasably coupled to the body, the plate being configured to cover a portion of the body when coupled thereto; and a projectile configured to be launched by the launching mechanism in response to activation of the actuator, the actuating opening being configured to receive the projectile, wherein pushing the projectile inwardly through the actuating opening releases the plate from the body.

2. The toy figurine of claim 1, wherein the body includes a torso portion, the launching mechanism is loadable from a launcher opening in a front side of the torso portion, and the actuating opening is located on a rear side of the torso portion.

3. The toy figurine of claim 1, wherein the plate at least partially covers the projectile configured to be launched by the launching mechanism when the plate is mounted to the body.

4. The toy figurine of claim 1, wherein the launching mechanism is a spring-loaded mechanism.

5. The toy figurine of claim 1, wherein the actuator is located inside the body and in communication with the actuating opening and the plate.

6. The toy figurine of claim 5, wherein movement of the projectile inwardly through the actuating opening moves the actuator to engage the plate and release the plate from the body.

7. A toy figurine, comprising:

a body including a first opening and a second opening formed therein, the body including a launching mechanism and an actuator;

a cover portion removably coupled to the body, the cover portion including a mounting component insertable into the first opening of the body; and a projectile removably coupled to the body, the projectile being insertable into the second opening of the body and engageable with the actuator, wherein insertion of the projectile into the second opening of the body moves the actuator to engage the mounting component in the first opening and release the cover portion from the body.

8. The toy figurine of claim 7, wherein the body includes a launching opening configured to receive the projectile, the cover is placed over the launching opening when the cover is coupled to the body, and the launching opening is exposed when the cover is released from the body.

9. The toy figurine of claim 8, wherein the actuator is located inside the body and is a first actuator, the body includes a second actuator, and activation of the second actuator results in the launching mechanism ejecting the projectile from the launching opening of the body.

10. The toy figurine of claim 9, wherein the first actuator is in communication with the first opening and the second opening.

11. The toy figurine of claim 10, wherein the projectile is configured to be inserted into the second opening to contact the first actuator and move the first actuator towards the first opening.

12. The toy figurine of claim 7, wherein the cover is configured to be released from the body when the projectile is pushed inwardly through the second opening relative to the body.

13. The toy figurine of claim 7, wherein the body includes a torso portion, the first opening is located in a front side of the torso portion, the second opening is located on a rear side of the torso portion.

14. The toy figurine of claim 7, wherein the launching mechanism is a spring-loaded mechanism.

15. A toy figurine, comprising:

a body including one or more plates releasably coupled to the body and configured to cover a portion of the body when coupled thereto;

a launching mechanism configured to receive and launch one or more projectiles; and an actuator capable of a first actuation and a second actuation, the second actuation occurring at a point in time after the first actuation, the actuator releasing the one or more plates upon the first actuation and launching the one or more projectiles from the launching mechanism upon the second actuation.

16. The toy figurine of claim 15, wherein the body includes a launching opening and the one or more plates cover the launching opening when the one or more plates are coupled to the body, and the launching opening is exposed when the one or more plates are released from the body.

17. The toy figurine of claim 15, wherein the body includes a head movably coupled to the body.

18. The toy figurine of claim 17, wherein the head is connected to the actuator and movement of the head activates the actuator.

19. The toy figurine of claim 15, wherein the one or more plates at least partially cover the one or more projectiles.

* * * * *